US011246422B2

(12) United States Patent
de Grasse

(10) Patent No.: US 11,246,422 B2
(45) Date of Patent: Feb. 15, 2022

(54) FLOATING LOUNGE WITH ADJUSTABLE SUPPORT MEMBER

(71) Applicant: Aqua-Leisure Industries, Inc., Avon, MA (US)

(72) Inventor: Scott R. de Grasse, Marshfield, MA (US)

(73) Assignee: Aqua-Leisure Recreation, LLC, Avon, MA (US)

( * ) Notice: Subject to any disclaimer, the term of this patent is extended or adjusted under 35 U.S.C. 154(b) by 67 days.

(21) Appl. No.: 16/857,893

(22) Filed: Apr. 24, 2020

(65) Prior Publication Data

US 2020/0337465 A1 Oct. 29, 2020

Related U.S. Application Data

(60) Provisional application No. 62/839,881, filed on Apr. 29, 2019.

(51) Int. Cl.
*A47C 15/00* (2006.01)
*A47C 1/14* (2006.01)

(52) U.S. Cl.
CPC ..... *A47C 15/006* (2013.01); *A47C 1/143* (2013.01); *A47C 1/146* (2013.01)

(58) Field of Classification Search
CPC ..... B63B 34/50; B63B 34/52; A47C 15/004; A47C 15/006; A47C 1/00; A47C 1/14; A47C 1/143; A47C 1/146
USPC ..... 441/129, 130
See application file for complete search history.

(56) References Cited

U.S. PATENT DOCUMENTS 2,946,068 A * 7/1960 Jasper ..... A47C 15/006 441/130
5,885,123 A * 3/1999 Clifford ..... B63B 34/50 441/129
6,045,423 A * 4/2000 Silvia ..... A47C 15/006 441/132
6,155,899 A * 12/2000 Boddy ..... B63B 34/50 441/130
6,227,925 B1 * 5/2001 Boddy ..... B63B 34/52 441/129
D897,473 S 9/2020 De Grasse et al.

* cited by examiner

*Primary Examiner* — Daniel V Venne
(74) *Attorney, Agent, or Firm* — Wolf, Greenfield & Sacks, P.C.

(57) ABSTRACT

A floating lounge comprising an outer, buoyant member surrounding a support member in the form of a panel of material extending forward from the rear of the lounge. The support member wraps around the front end of the lounge and extends back toward the rear of the lounge. Connectors provided on the longitudinal edges of the support member allow the forward-extending portion of the support member to be secured to the rearward-extending portion to form a sling depending between the front and rear sides of the lounge, for supporting the user, and whereby the user may choose among several possible shapes for the support member by appropriately mating the sets of connectors.

2 Claims, 5 Drawing Sheets

FLOATING LOUNGE WITH ADJUSTABLE SUPPORT MEMBER

RELATED APPLICATION

This application claims priority under 35 U.S.C. Section 119(e) to U.S. Provisional Application Ser. No. 62/839,881, entitled "FLEXIBLE LOUNGE WITH ADJUSTABLE SEAT," filed on Apr. 29, 2019, which application is hereby incorporated by reference in its entirety for all purposes.

FIELD OF THE INVENTION

This invention relates to a floating lounge, and particularly to a floating lounge having a flexible support member for supporting the user, the shape of the support member being adjustable to allow the user to choose a desired position on the lounge.

SUMMARY OF THE INVENTION

Floating mattress or lounges are among the most popular beach and pool recreational devices. They are typically inflatable and may comprise a bladder or buoyant member forming the outer portion of the device, with an inner portion, often constructed of a layer of plastic or mesh material upon which the user sits or reclines, attached around the inner perimeter of the buoyant member. Some lounges have a raised portion at one end of the buoyant member, which raised portion may serve as a headrest and/or back cushion. However, because the inner portion of the device is typically fixed in position and shape, it may not provide optimum comfort for users of different sizes or for a user who desires to change his or her position or posture.

One embodiment of the lounge of the instant invention comprises an inflatable, tubular, buoyant body member formed generally in the shape a rectangle, surrounding a support area. A panel of flexible material, such as plastic mesh, is attached only to a first side of the body member. A first portion of the panel extends from the first side of the body member toward and under a second side of the body member, opposite the first side. A second portion of the panel continues around and over the opposite side of the body member, and then back toward the first side of the body member. Connectors located on the longitudinal edges of the first portion of the panel may be mated with corresponding connectors located on the longitudinal edges of the second portion of the panel to secure the panel in place, wrapped around said second side of the body member to form a sling-like support member depending from the first and second sides of the body member, for supporting the user. The user may selectively change the effective length and shape of the support member by mating the appropriate pairs of connectors in order to choose the most comfortable configuration of the support member.

DETAILED DESCRIPTION OF THE DRAWINGS

DETAILED DESCRIPTION OF THE INVENTION

Figure 1:
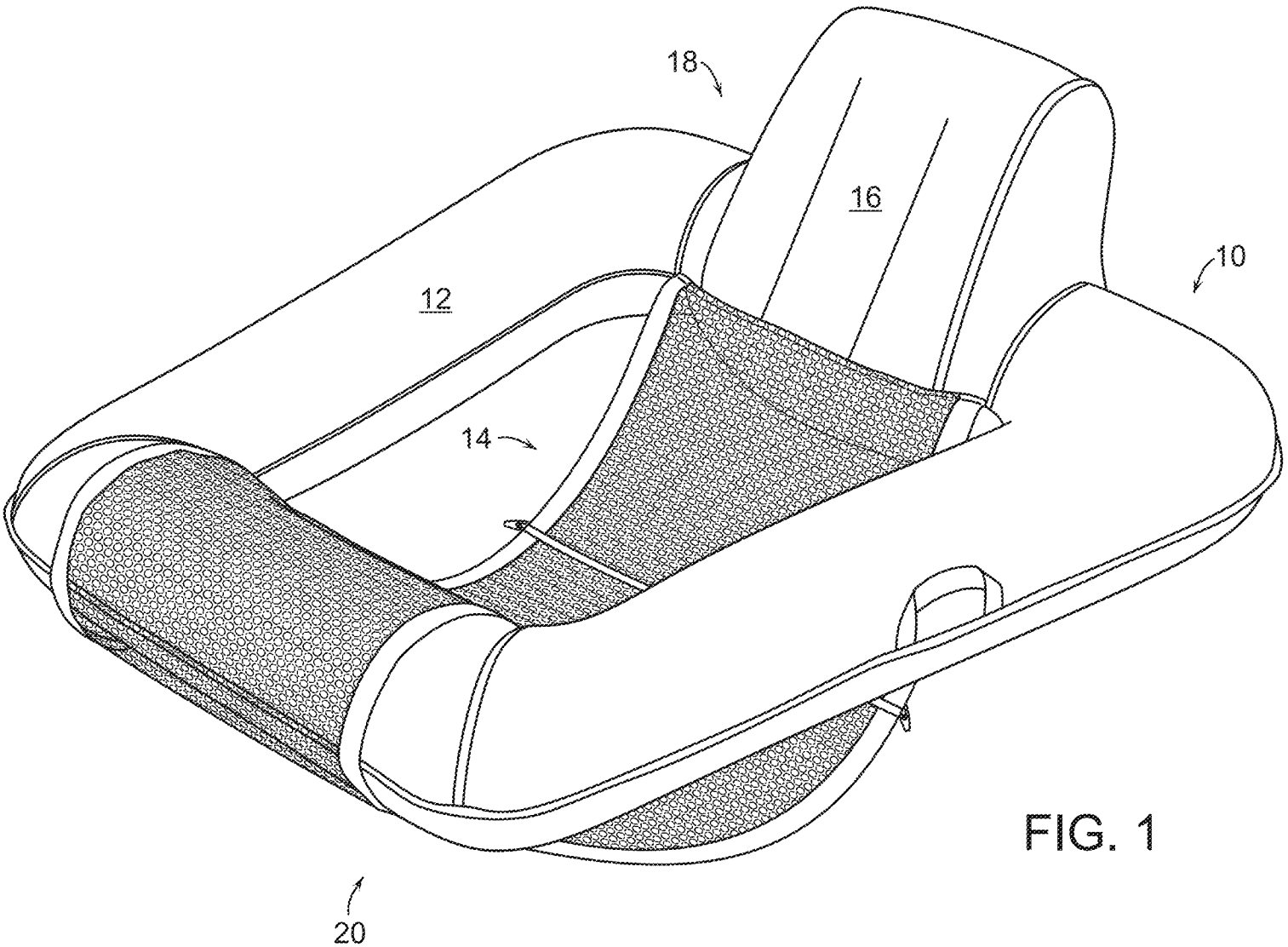
FIG. 1 depicts a floating lounge having an adjustable support member for supporting the user.

FIG. 1 depicts floating lounge 10 having a buoyant, tubular body member 12 in a generally rectangular configuration and surrounding a support member 14. Body member 12 includes a back or headrest 16 at the rear side 18 of the body member 12. Support member 14 comprises an elongated panel of flexible material attached to body member 12 at the rear side 18 of the lounge and extending forward toward the front side 20 of body member 12, as explained more fully below.

Figure 2:
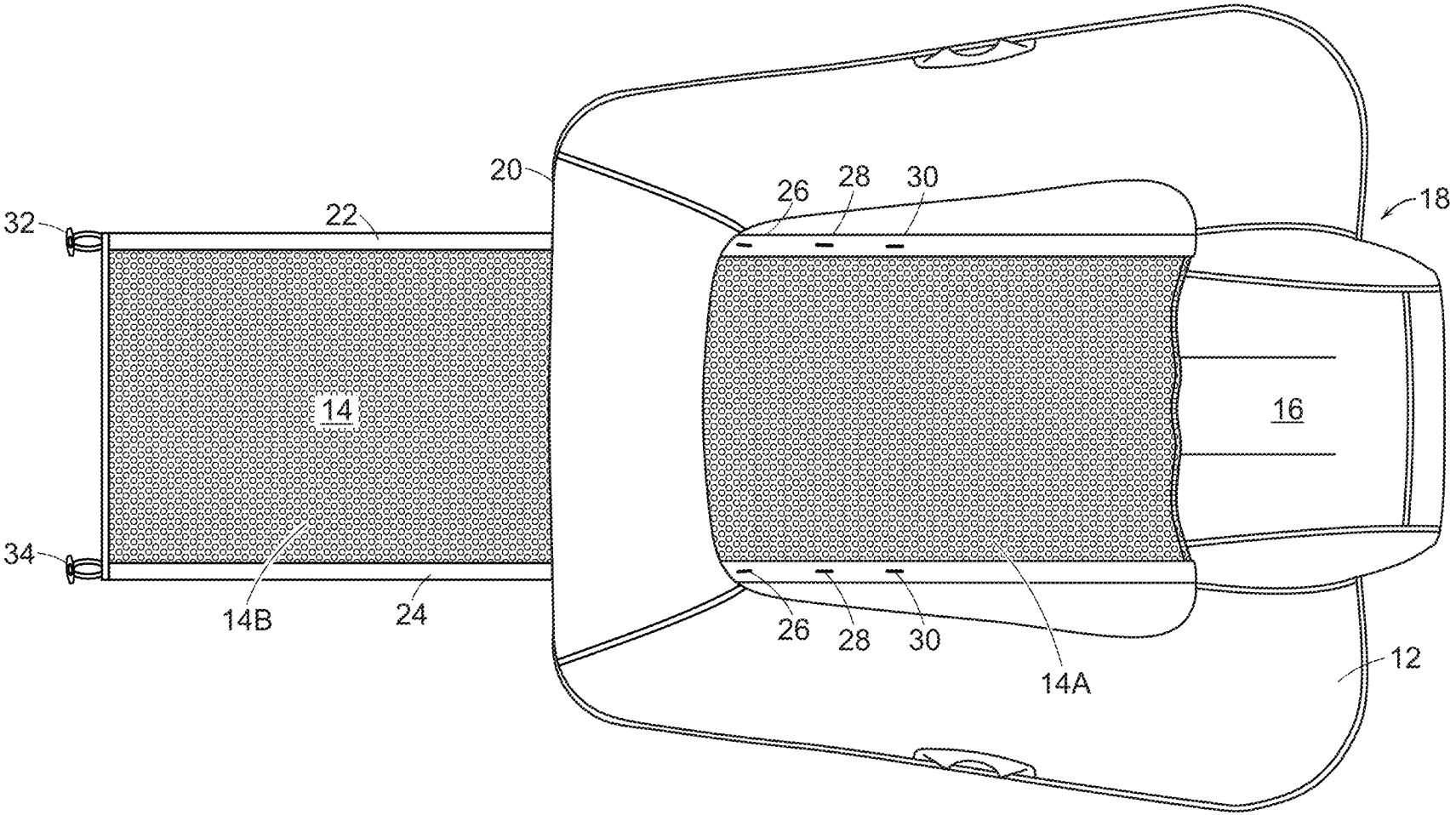
FIG. 2 depicts the floating lounge with the adjustable support member extended fully from the rear side of the floating lounge and under the front side of the lounge.

FIG. 2 depicts a first portion 14A of support member 14 extending from the rear side 18 of body member 12, toward and under the front side 20 of body member 12, and continuing as portion 14B. In this particular embodiment, support member 14 is preferably made of plastic mesh material having longitudinal edges 22 and 24 made of binding material. Support member 14 includes a series of button hole-like apertures 26, 28, 30 in pairs located across from each other, on longitudinal edges 22 and 24 of support member 14. A toggle connector 32, 34 is located at each corner of portion 14B of support member 14 farthest from the rear side 18 of body member 12, as shown in FIG. 2.

Figure 3:
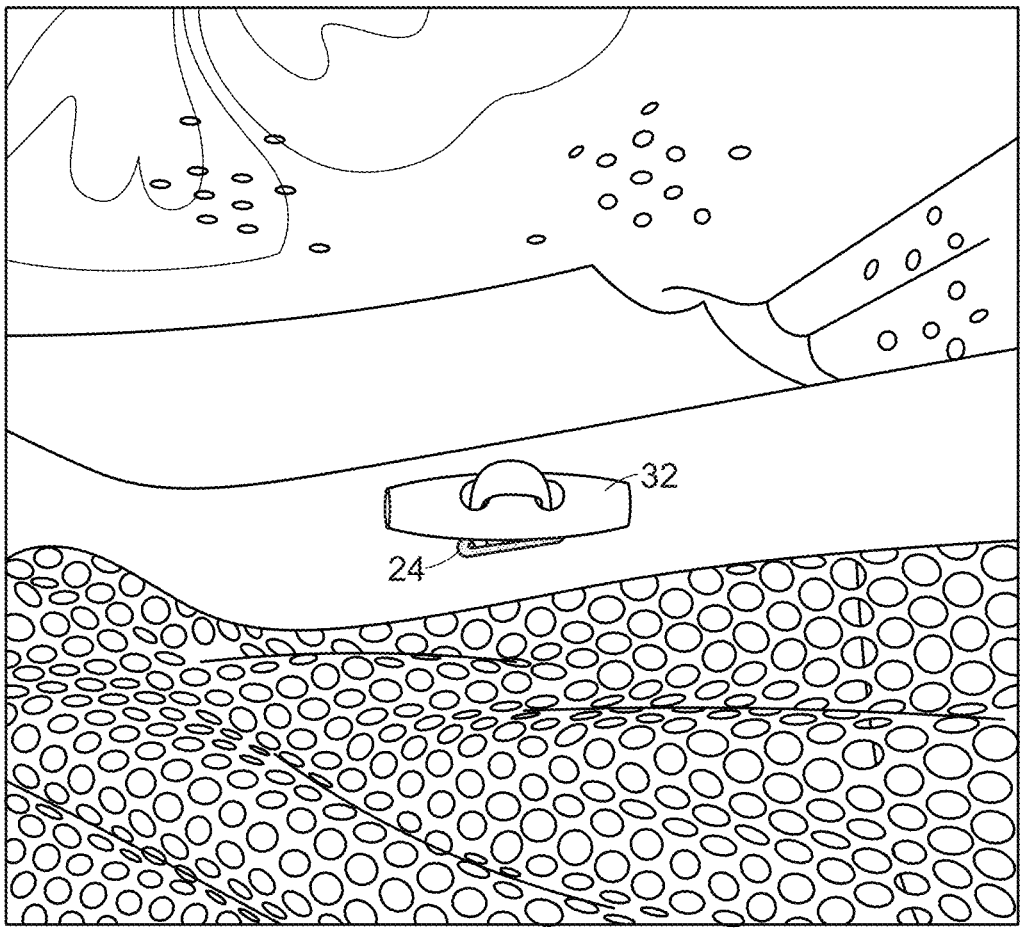
FIG. 3 depicts one of the toggles on the distal portion of the support member mated through an aperture on the portion of the support member nearer the rear of the lounge, in order to create a sling-like support for the user.

When support member 14 (see FIG. 2) is folded back over the front side 20 of body member 12 and toward rear side 18, toggle connectors 32 and 34 may be fastened to support member portion 14A via one of the pair of apertures 26, 28, or 30 (as in FIG. 3 below), thus forming the support member into a loop or band of material around front side 20 of body member 12 so that, when a user sits or lays on support member 14, the weight of the user will pull support member 14 tight around the top of the front side 20 of body member 12 to form a sling-like support member 14.

Figure 4:
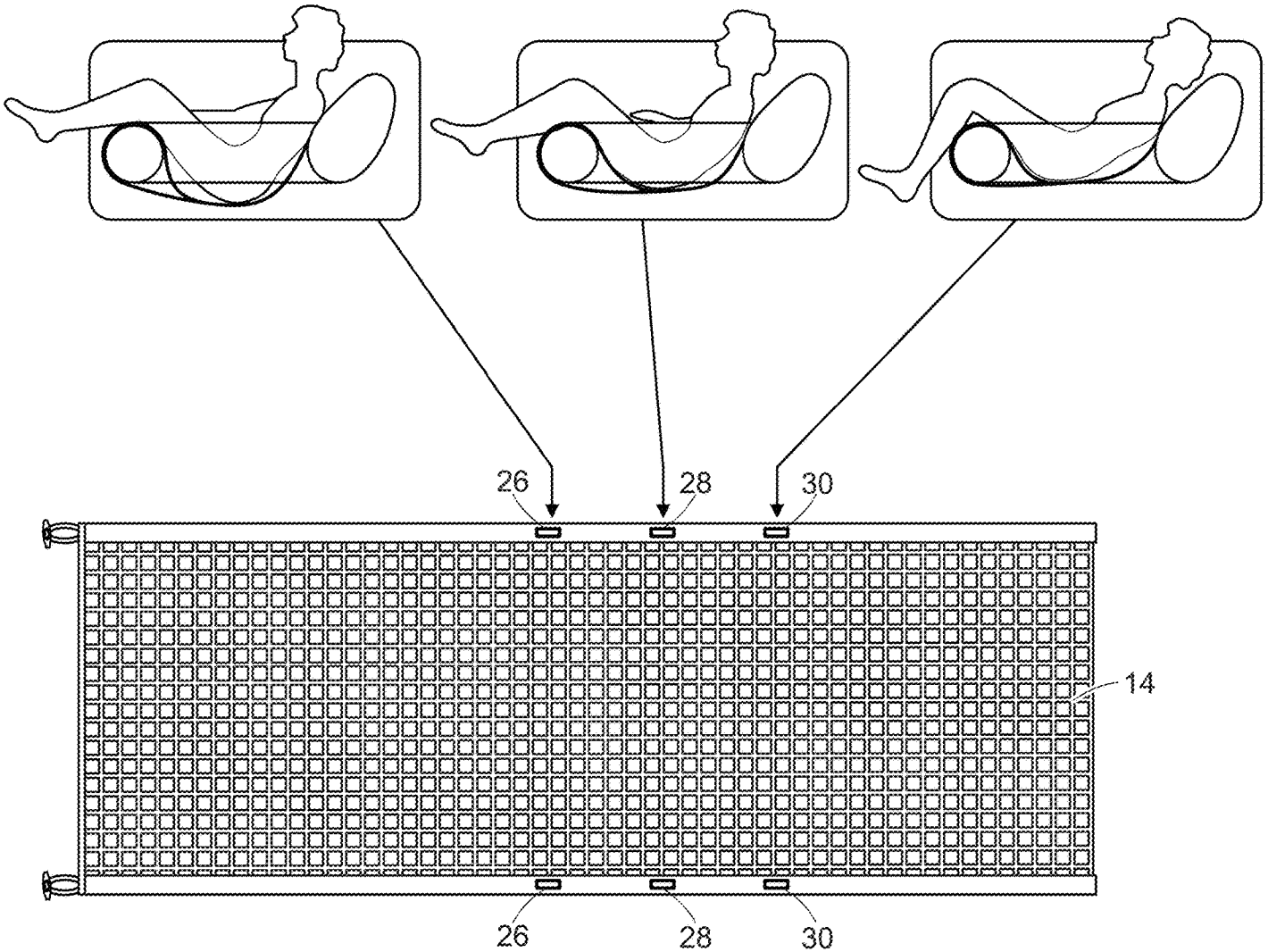
FIG. 4 depicts three possible positions of the support member, depending on the choice of connectors employed.

FIG. 4 illustrates a support member 14 having three pairs of apertures 26, 28, 30 for selective receipt of toggle connectors 32 and 34, thus providing three possible positions or configurations of support member 14 as it hangs below body member 12 in sling-like fashion.

Figure 5:
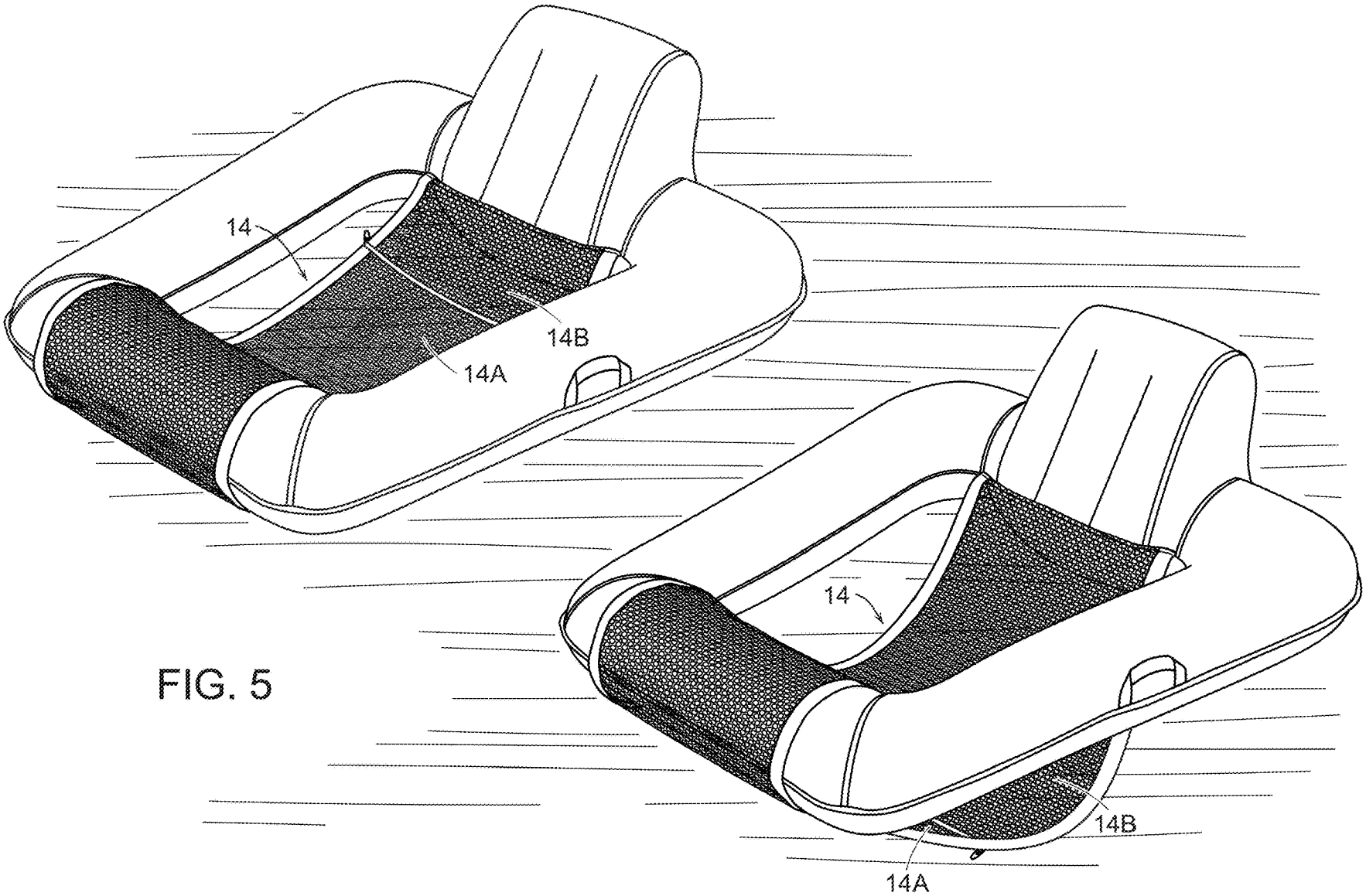
FIG. 5 depicts the lounge with the support member secured in two different positions.

FIG. 5 depicts two possible positions of support member 14 according to one embodiment of the instant invention.

Accordingly, the user of the lounge 10 may select which configuration of support member 14 is most comfortable or appropriate, by choosing where to connect portion 14A to portion 14B. The embodiments here illustrated utilize three pairs of apertures for receipt of the toggle connectors, but the invention is not limited to any particular number of connector pairs. Although support member 14 could first extend over the front side of body member 12 rather than under, and then wrap underneath the front side of lounge 10 before the toggle connectors are mated with the paired apertures, this configuration is less desirable. Other types of connectors could also be used, provided they appropriately secure together the two portions of the support member.

From the description of at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting.

I claim:

1. A floating lounge comprising:

A buoyant body member surrounding an inner area, said buoyant body member having a front side and a rear side;

a support member located in the inner area for supporting a user of the floating lounge, said support member comprising an elongated panel of material attached to the rear side of the buoyant body member and having a first portion extending from the rear side to the front side of the buoyant body member, and a second portion extending continuously from the first portion, around the front side of the buoyant body member, and back toward the rear side of the buoyant body member; and a plurality of connectors on the first portion of the support member attachable to corresponding connectors on the second portion of the support member to allow securement of the first portion of the support member to the second portion of the support member within said inner area of said buoyant body member so that said support member depends between the rear side and the front side of the buoyant body member.

2. The floating lounge of claim 1 whereby the user, by selecting and pairing connectors on the first portion of the support member with connectors on the second portion of the support member, may change a length of the support member between the rear side and front side of the buoyant body member.

* * * * *